US009379461B2

(12) United States Patent
Naganishi et al.

(10) Patent No.: US 9,379,461 B2
(45) Date of Patent: Jun. 28, 2016

(54) GROUNDING TERMINAL

(71) Applicant: Yazaki Corporation, Tokyo (JP)

(72) Inventors: Yukinari Naganishi, Makinohara (JP); Takatatsu Yamamoto, Makinohara (JP); Kousuke Kinoshita, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/666,357

(22) Filed: Mar. 24, 2015

(65) Prior Publication Data

US 2015/0280332 A1 Oct. 1, 2015

(30) Foreign Application Priority Data

Mar. 25, 2014 (JP) ..... 2014-062167

(51) Int. Cl.

| | |
|---|---|
| ***H01R 11/01*** | (2006.01) |
| ***H01R 4/30*** | (2006.01) |
| ***H01R 4/64*** | (2006.01) |
| ***H01R 11/12*** | (2006.01) |

(52) U.S. Cl.

CPC ..... *H01R 4/30* (2013.01); *H01R 4/302* (2013.01); *H01R 4/64* (2013.01); *H01R 11/12* (2013.01); *H01R 2201/26* (2013.01)

(58) Field of Classification Search

CPC ..... H01R 4/30; H01R 4/302; H01R 4/64; H01R 11/12; H01R 2201/26

USPC ..... 439/781, 782

See application file for complete search history.

(56) References Cited

U.S. PATENT DOCUMENTS

| | | | | |
|---|---|---|---|---|
| 5,692,930 | A * | 12/1997 | Garver | H01R 4/44 439/781 |
| 8,366,495 | B2 * | 2/2013 | Nagy | H01R 4/304 439/781 |
| 2013/0157513 | A1 * | 6/2013 | Hagen | H01R 13/405 439/638 |
| 2014/0134897 | A1 * | 5/2014 | Akuta | H01R 9/18 439/782 |
| 2014/0335743 | A1 * | 11/2014 | Kakimi | H01R 4/30 439/781 |

FOREIGN PATENT DOCUMENTS

JP 2006324052 A 11/2006

* cited by examiner

*Primary Examiner* — Khiem Nguyen

(74) *Attorney, Agent, or Firm* — Sughrue Mion, PLLC

(57) ABSTRACT

A grounding terminal includes a first grounding terminal including a first bolt insertion portion and a third bolt insertion portion, and a second grounding terminal including a second bolt insertion portion and a fourth bolt insertion portion. In a state that the first grounding terminal and the second grounding terminal are stacked on to each other, the first grounding terminal and the second grounding terminal are fastened and fixed to a fixation target by first and second bolts at first and second fastening portions. In the second fastening portion, the third bolt insertion portion and the fourth bolt insertion portion are stacked on to each other. The third bolt insertion portion has an elliptic shape or an oval shape. The fourth bolt insertion portion is opened and formed to be larger than the third bolt insertion portion.

2 Claims, 10 Drawing Sheets

GROUNDING TERMINAL

BACKGROUND

1. Technical Field

The present invention relates to a grounding terminal and particularly relates to a grounding terminal which includes a first grounding terminal and a second grounding terminal and in which the first grounding terminal and the second grounding terminal stacked on to each other and locked with each other are fastened and fixed to a connection/fixation target by bolts.

2. Background Art

In FIG. 7, an electric wire 101 is electrically connected to a connection/fixation target typically by use of a terminal fitting 102. The terminal fitting 102 is formed by press working out of a metal plate having electrical conductivity. The terminal fitting 102 includes a terminal body 103 and an electric wire connection portion 104. An insertion hole (not shown) is formed in the terminal body 103. A bolt 105 is inserted into the insertion hole. When the bolt 105 is fastened and fixed to the connection/fixation target, electric connection is completed concurrently. On the other hand, crimping pieces 106 and 107 are formed in the electric wire connection portion 104 continuing to the terminal body 103 formed thus. The crimping pieces 106 and 107 are portions on which crimping is performed. The crimping pieces 106 and 107 are formed so that a conductor exposed portion and an insulator of a terminal of the electric wire 101 can be electrically and mechanically connected and fixed to the crimping pieces 106 and 107 respectively. The typical terminal fitting 102 and its connection have been described above.

For example, in a vehicle such as a car, not The terminal fitting 102 but a special terminal fitting as shown in FIG. 8 and FIG. 9, that is, a grounding terminal 121 is used for grounding connection to a vehicle body (for example, see JP-A-2006-324052). This is because the grounding terminal 121 has a structure in which a plurality of electric wires 122 and 123 can be efficiently connected to a single place. The grounding terminal 121 shown in FIG. 8 and FIG. 9 includes a first grounding terminal 124 which is provided at a terminal of the electric wire 122 and a second grounding terminal 125 which is provided at a terminal of the electric wire 123.

The first grounding terminal 124 has a first grounding terminal body 126 which has a plate-like shape and a first electric wire connection portion 127 which crimps a terminal of the electric wire 122. The second grounding terminal 125 also has a second grounding terminal body 128 which has a plate-like shape and a second electric wire connection portion 129 which crimps a terminal of the electric wire 123. The first grounding terminal body 126 and the second grounding terminal body 128 have a structure as follows. That is, the first grounding terminal body 126 and the second grounding terminal body 128 are stacked on to each other and integrated with each other. The first grounding terminal body 126 and the second grounding terminal body 128 which have been stacked on to each other are fastened and fixed to a body 131 or the like by a bolt 130. Thus, grounding connection is completed.

The structure will be described more specifically. A first bolt hole 132 is formed in the first grounding terminal body 126. In addition, a first lock portion 133 is formed near the first bolt hole 132. In the same manner, a second bolt hole 134 and a second lock portion 135 are formed in the second grounding terminal body 128. When the first grounding terminal body 126 and the second grounding terminal body 128 are stacked on to each other and integrated with each other, the portion corresponding to the first bolt hole 132 and the second bolt hole 134 is formed as a fastening portion 136.

However, there is a fear that the grounding terminal 121 may cause a trouble of terminal detachment due to looseness occurring in the bolt 130. Therefore, the present inventor invented to provide a grounding terminal 143 including two fastening portions 141 and 142 as shown in FIG. 10.

The grounding terminal 143 is designed to include a first grounding terminal 144 and a second grounding terminal 145. The first grounding terminal 144 includes a first grounding terminal body 146 which has a plate-like shape and a first electric wire connection portion 148 which crimps a terminal of an electric wire 147. The second grounding terminal 145 also has a second grounding terminal body 149 which has a plate-like shape and a second electric wire connection portion 151 which crimps a terminal of the electric wire 150. A pair of first bolt holes 152 and 153 are formed in the first grounding terminal body 146. On the other hand, a pair of second bolt holes 154 and 155 are also formed in the second grounding terminal body 149.

The first bolt holes 152 and 153 of the first grounding terminal body 146 and the second bolt holes 154 and 155 of the second grounding terminal body 149 are formed into circular shapes with the same dimensions and at the same positions respectively. In addition, the first bolt holes 152 and 153 and the second bolt holes 154 and 155 are formed in accordance with the size of the shaft portion of each bolt 156. When the first grounding terminal body 146 and the second grounding terminal body 149 are stacked on to each other, two fastening portions 141 and 142 are formed. Two bolts 156 are then inserted and fastened into the first bolt holes 152 and 153 and the second bolt holes 154 and 155 respectively. Thus, grounding connection is completed.

In the grounding terminal 143 configured thus, there is an effect that the grounding function can be kept even if looseness occurs in any one of the two bolts 156.

However, the present inventor found out the following problem in the grounding terminal 143. That is, the present inventor found out a problem that if there are dimensional variations on manufacturing in the first bolt holes 152 and 153 of the first grounding terminal 144, the second bolt holes 154 and 155 of the second grounding terminal 145 and not-shown body-side bolt holes, troubles may occur, for example, in insertion or fastening of the bolts 156 due to the use of the fastening structure using the two bolts 156 so that normal grounding connect cannot be achieved.

Incidentally the present inventor considered that, when lock portions similar to the first lock portion 133 and the second lock portion 135 in FIG. 9 are provided near the first bolt hole 152 in the first grounding terminal 144 and near the second bolt hole 154 in the second grounding terminal 145, The dimensional variations can be absorbed by backlash generated by the lock portions. However, there is a fear that misalignment may occur when the first grounding terminal 144 and the second grounding terminal 145 are stacked on to each other and locked with each other. Thus, the present inventor understood that it is necessary to reconsider the shapes or dimensions of the first bolt holes 152 and 153 and the second bolt holes 154 and 155.

The present invention has been developed in consideration of the circumstances. An object of the invention is to provide a grounding terminal capable of absorbing dimensional variations or misalignment occurring due to various factors so as to achieve normal grounding connection.

SUMMARY

In order to attain the foregoing object, a first configuration of the invention provides a grounding terminal which includes a first grounding terminal including a first bolt insertion portion and a third bolt insertion portion, and a second grounding terminal including a second bolt insertion portion and a fourth bolt insertion portion, wherein in a state that the first grounding terminal and the second grounding terminal are stacked on to each other and locked with each other, the first grounding terminal and the second grounding terminal are fastened and fixed to a fixation target by a first bolt and a second bolt at a first fastening portion and a second fastening portion, wherein in the first fastening portion, the first bolt insertion portion and the second bolt insertion portion are stacked on to each other and locked with each other, wherein in the second fastening portion, the third bolt insertion portion and the fourth bolt insertion portion are stacked on to each other, the third bolt insertion portion having an elliptic shape or an oval shape whose longitudinal direction is a direction in which the first fastening portion and the second fastening portion are aligned, and wherein the fourth bolt insertion portion is opened and formed to be larger than the third bolt insertion portion and smaller than a fastening member.

According to the configuration of the invention, one of the two fastening portions can serve as a portion for absorbing dimensional variations.

According to a second configuration of the invention, the grounding terminal according to the first configuration is characterized in that the first grounding terminal and the second grounding terminal include electric wire collective connection portions which collectively connect terminals of a plurality of electric wires, respectively.

According to the configuration of the invention characterized thus, a large number of grounding circuits (a plurality of electric wires) can be connected to the grounding terminal through the electric wire collective connection portions.

According to the first configuration of the invention, two fastening portions are provided, and one of the fastening portions is constituted by a third bolt insertion portion which has an elliptic shape or an oval shape and a fourth insertion portion which is opened with a large diameter. Thus, there is an effect that, due to the fastening portion including the third bolt insertion portion and the fourth bolt insertion portion, it is possible to absorb dimensional variations or positional misalignment. Examples of the dimensional variations or misalignment may include dimensional variations or misalignment caused by formation of body-side bolt holes or erection of bolts on the body side, dimensional variations or misalignment caused by manufacturing of the grounding terminal, misalignment occurring when the first grounding terminal and the second grounding terminal are put on each other and locked with each other in the grounding terminal, and so on. Accordingly, due to use of the grounding terminal according to the invention, there is an effect that normal grounding connection can be achieved. In addition, according to the grounding terminal, there is also an effect that due to the two fastening portions, the fixed state can be kept in spite of looseness occurring in any one of the bolts, so that the grounding function can be kept.

According to the second configuration of the invention, the following effect can be obtained in addition to the effects of the first configuration. That is, due to the first grounding terminal and the second grounding terminal having electric wire collective connection portions, there is an effect that a large number of grounding circuits can be connected compactly and inexpensively at a reduced number of grounding points.

DETAILED DESCRIPTION OF EXEMPLARY EMBODIMENTS

In recent development of vehicles, troubles may occur in a vehicle system due to influence of noise which is considered to be caused by ground potential. In a form of grounding connection using a body of a vehicle, it is necessary to obtain ideal and clean grounding connection for noise. The present invention is to provide a grounding terminal which is effective in grounding not through any joint but directly to a body as a measure against noise.

Specifically, the grounding terminal includes a first grounding terminal and a second grounding terminal and has a structure in which two fastening portions are formed when the first grounding terminal and the second grounding terminal are stacked on to each other and locked with each other. In addition, the grounding terminal has a structure in which one of the two fastening portions is formed into a state in which an elliptic or oval bolt insertion portion and a circular bolt insertion portion are stacked on to each other. Due to the grounding terminal configured thus, it is possible to absorb dimensional variations or misalignment caused by manufacturing of the grounding terminal, dimensional variations or misalignment caused by formation of bolt holes or erection of bolts on the body side, and misalignment occurring when the first grounding terminal and the second grounding terminal are put on each other and locked with each other. Accordingly, the grounding terminal has a structure effective in achieving direct grounding to the body.

The grounding terminal has electric wire collective connection portions, by which a large number of grounding circuits can be connected compactly and inexpensively at a reduced number of grounding points.

EXAMPLE 1

Figure 1:
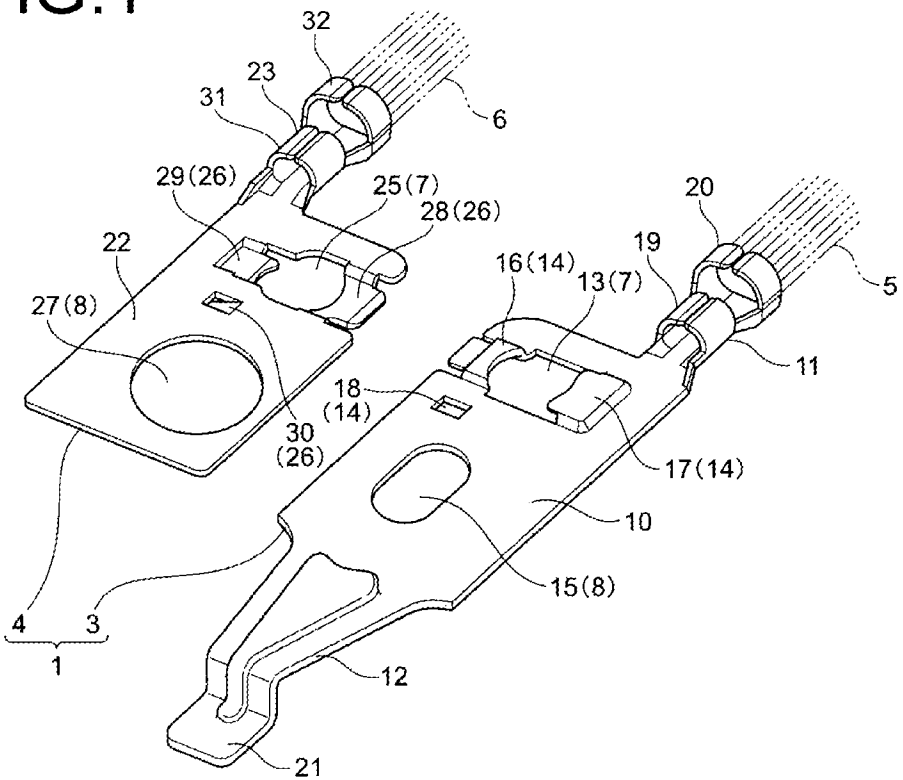
FIG. 1 is a perspective view showing a grounding terminal according to the invention, in which a first grounding terminal and a second grounding terminal have not yet been stacked on to each other (Example 1).
Figure 2:
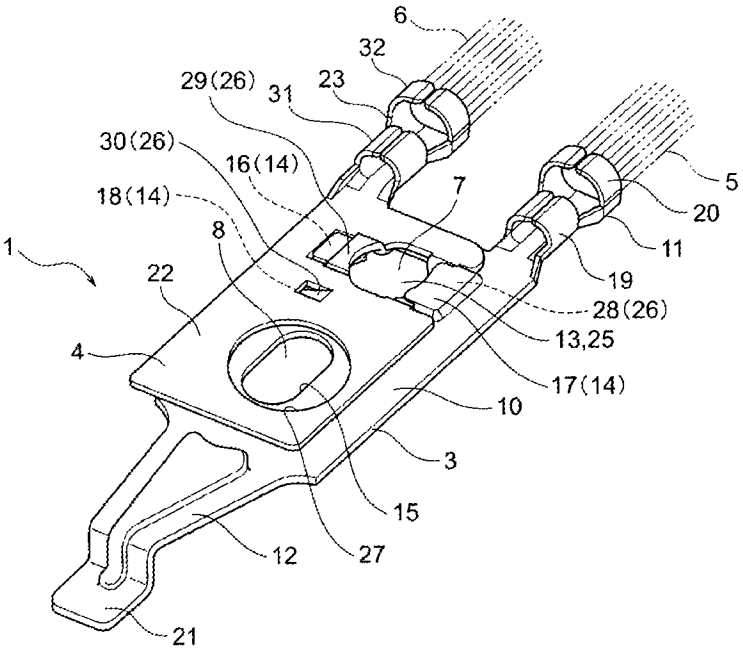
FIG. 2 is a perspective view showing a state in which the first grounding terminal and the second grounding terminal in FIG. 1 have been stacked on to each other and locked with each other (Example 1).
Figure 3:
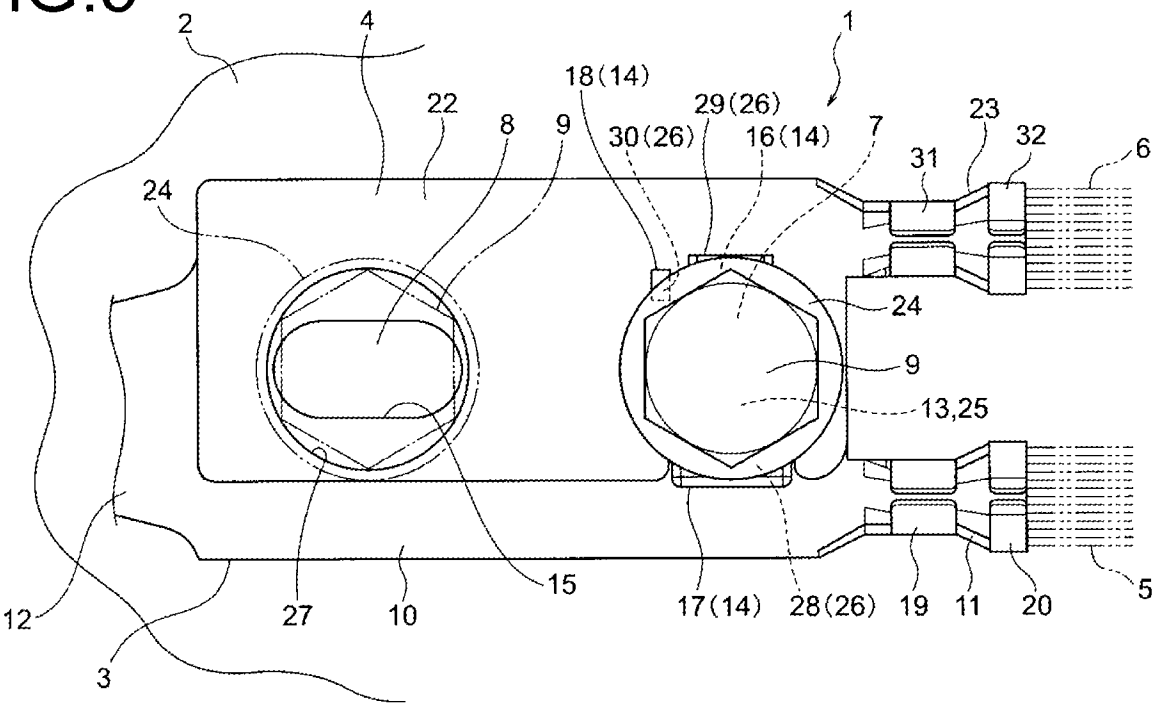
FIG. 3 is a plan view showing a state in which the first grounding terminal and the second grounding terminal in the state of FIG. 2 are being fastened by bolts (Example 1).

Example 1 will be described below with reference to the drawings. FIG. 1 is a perspective view showing a grounding terminal according to the invention, in which a first grounding terminal and a second grounding terminal have not yet been stacked on to each other. FIG. 2 is a perspective view showing a state in which the first grounding terminal and the second grounding terminal in FIG. 1 have been stacked on to each other and locked with each other. FIG. 3 is a plan view showing a state in which the first grounding terminal and the second grounding terminal in the state of FIG. 2 are being fastened by bolts.

In FIG. 1 to FIG. 3, the reference numeral 1 represents a grounding terminal which will be grounded directly to a body 2 (connection/fixation target) of a vehicle. The grounding terminal 1 is designed to include a first grounding terminal 3 and a second grounding terminal 4. The first grounding terminal 3 is provided at a terminal of an electric wire group 5. On the other hand, the second grounding terminal 4 is provided at a terminal of an electric wire group 6. The first grounding terminal 3 and the second grounding terminal 4 are connected and fixed to a predetermined one place in the body 2 in a state where the first grounding terminal 3 and the second grounding terminal 4 have been stacked on to each other and locked with each other, that is, in a state as the grounding terminal 1. Due to connection of the grounding terminal 1, the electric wire groups 5 and 6 are grounded to the body 2 collectively.

The grounding terminal 1 has two fastening portions (a first fastening portion 7 and a second fastening portion 8) for the connection/fixation of the grounding terminal 1 to the body 2. Bolts 9 (fastening members) are inserted and fastened into the two fastening portions respectively so that the grounding terminal 1 can be connected and fixed to the body 2.

When the first grounding terminal 3 and the second grounding terminal 4 are observed on the side of the electric wire groups 5 and 6, the first grounding terminal 3 is regarded as a left grounding terminal (left terminal) and the second grounding terminal 4 is regarded as a right grounding terminal (right terminal). In this example, the first grounding terminal 3 which is a left grounding terminal is a terminal which will make contact with the body 2.

The configurations and structures of the first grounding terminal 3 and the second grounding terminal 4 will be described below in detail.

The first grounding terminal 3 is a metal component for electric connection. The first grounding terminal 3 is produced by press working out of a metal plate having electrical conductivity. The first grounding terminal 3 produced thus is formed into a depicted shape including a first grounding terminal body 10, a first electric wire collective connection portion 11 and a body lock portion 12 (the shape is exemplary). The first grounding terminal 3 is formed into a shape which can make electric contact with the surface of the body 2. The first electric wire collective connection portion 11, the first grounding terminal body 10 and the body lock portion 12 are arranged along the terminal axis direction of the first grounding terminal 3, which is formed to be longer than the second grounding terminal 4. In this example, the third grounding terminal 3 is formed to be longer by the length of the body lock portion 2.

The first grounding terminal body 10 is formed as a plate-like portion. In addition, the first grounding terminal body 10 is formed as a portion which is substantially rectangular in planar view. The first grounding terminal body 10 is formed so that its front surface can serve as a contact surface with the second grounding terminal 4 and its back surface can serve as a contact surface with the body 2. A first bolt hole 13 (first bolt insertion portion), a body first lock portion 14 and a third bolt hole 15 (third bolt insertion portion) are formed in the first grounding terminal body 10 configured thus. In this example, it is assumed that the "first" and "third" bolt holes are located on the first grounding terminal 3 side as described above and "second" and "fourth" bolt holes (bolt insertion portions) are located on the second grounding terminal 4 side.

The first bolt hole 13 is formed and disposed on the rear end side (first electric wire collective connection portion 11 side) of the first grounding terminal body 10. The first bolt hole 13 is formed as a portion to which the bolt 9 will be inserted and as a portion which constitutes the first fastening portion 7. The first bolt hole 13 is formed so that a shaft portion of the bolt 9 can be inserted thereto. In this example, the body first lock portion 14 which will be described later is disposed in a hole edge portion of the first bolt hole 13. Therefore, the first bolt hole 13 is formed into a non-circular shape.

The body first lock portion 14 is formed as a portion (lock portion) which can bring the first grounding terminal 3 and the second grounding terminal 4 into a lock state when the first grounding terminal 3 and the second grounding terminal 4 are stacked on to each other. In this example, the body first lock portion 14 is designed to include a right first main lock portion 16, a left first main lock portion 17 and a first auxiliary lock portion 18. The right first main lock portion 16 and the left first main lock portion 17 are formed and disposed in the hole edge portion of the first bolt hole 13. The first auxiliary lock portion 18 is formed and disposed near the first bolt hole 13. Incidentally, the configuration of the body first lock portion 14 is exemplary. It will go well if the body first lock portion 14 serves as a lock portion.

The third bolt hole 15 is formed and disposed on the front end side (body lock portion 12 side) of the first grounding terminal body 10. The third bolt hole 15 is formed as a portion to which the bolt 9 will be inserted and as a portion which constitutes the second fastening portion 8. The third bolt hole 15 is formed so that a shaft portion of the bolt 9 can be inserted thereto. As is understood from the drawings, the third bolt hole 15 is different from The first bolt hole 13 at the point that the shape of the third bolt hole 15 is oval (the oval shape is exemplary).

The third bolt hole 15 and the first bolt hole 13 are disposed to be arranged in the terminal axis direction and at a predetermined distance from each other. The oval third bolt hole 15 is formed so that its longitudinal direction extends in the terminal axis direction. The longitudinal length of the third bolt hole 15 is set to be long enough to absorb dimensional variations or misalignment which will be described alter (the longitudinal length may be set desirably). On the other hand, the lateral length of the third bolt hole 15 is set in accordance with the diameter of the shaft portion of the bolt 9 (by way of example). Incidentally, the hole shape of the third bolt hole 15 is not limited to the oval shape, but may be an elliptic shape. When the hole shape of the third bolt hole 15 is oval, the contact area with a washer 24 which will be described later can be secured to be larger than when the hole shape of the third bolt hole 15 is elliptic. It is therefore possible to prevent deterioration in surface pressure so that the reliability can be improved. The elliptic shape is one of shapes effective in absorbing dimensional variations or misalignment which will be described later.

The first electric wire collective connection portion 11 is formed continuously to the rear end of the first grounding terminal body 10. The first electric wire collective connection portion 11 is formed and disposed in a position where the first electric wire collective connection portion 11 cannot interfere with a second electric wire collective connection portion 23 (which will be described later) on the second grounding terminal 4 side when the first grounding terminal 3 and the second grounding terminal 4 are stacked on to each other. The first electric wire collective connection portion 11 is formed and disposed in a left corner position of the rear end in this example. The first electric wire collective connection portion 11 configured thus is formed as a portion which electrically and mechanically connects and fixes the electric wire group 5. In this example, the first electric wire collective connection portion 11 includes a pair of first conductor crimping pieces 19 which fasten the conductor portion of the electric wire group 5 and a pair of first sheath crimping pieces 20 which crimps the sheath portion of the electric wire group 5. The electric connection is not limited to connection by crimping. For example, another known connection manner such as welding or deposition may be used.

The body lock portion 12 is formed continuously to the front end of the first grounding terminal body 10. The body lock portion 12 is formed into a tempered shape like an arm. A front end lock portion 21 is formed at the front end of the body lock portion 12 so that the front end lock portion 21 can be inserted into a not-shown hole portion of the body 2 and locked therewith. When the front end lock portion 21 is locked, the terminal is restrained from unnecessary turning when the bolt 9 is being fastened. Incidentally, the formation of the body lock portion 12 is optional.

The second grounding terminal 4 is a metal component for electrical connection in the same manner as the first grounding terminal 3. The second grounding terminal 4 is also produced by press working out of a metal plate having electrical conductivity. The second grounding terminal 4 produced thus is formed into a depicted shape including a second grounding terminal body 22 and a second electric wire collective portion 23 (the shape is exemplary). The second grounding terminal 4 is formed into a shape which can make electrical contact with the surface of the first grounding terminal 3. In the second grounding terminal 4, the second grounding terminal body 22 and the second electric wire collective connection portion 23 are formed and disposed in accordance with the positions of the first grounding terminal body 10 and the first electric wire collective connection portion 11 of the first grounding terminal 3.

The second grounding terminal body 22 is formed as a plate-like portion. In addition, the second grounding terminal body 22 is formed as a portion which is substantially rectangular in planar view. The second grounding terminal body 22 is formed so that its back surface can serve as a contact surface with the first grounding terminal 3 and its front surface can serve as a surface receiving pressure from a washer 24 (fastening member) when the bolt 9 is fastened. A second bolt hole 25 (second bolt insertion portion), a body second lock portion 26 and a fourth bolt hole 27 (fourth bolt insertion portion) are formed in the second grounding terminal body 22 configured thus.

The second bolt hole 25 is formed and disposed on the rear end side (second electric wire collective connection portion 23 side) of the second grounding terminal body 22. The second bolt hole 25 is formed as a portion to which the bolt 9 will be inserted and as a portion which constitutes the first fastening portion 7. The second bolt hole 25 is formed so that a shaft portion of the bolt 9 can be inserted thereto. In this example, the body second lock portion 26 which will be described later is disposed in a hole edge portion of the second bolt hole 25. Therefore, the second bolt hole 25 is formed into a non-circular shape.

The body second lock portion 26 is formed as a portion (lock portion) which can bring the first grounding terminal 3 and the second grounding terminal 4 into a lock state when the first grounding terminal 3 and the second grounding terminal 4 are stacked on to each other. In this example, the body second lock portion 26 is designed to include a left second main lock portion 28, a right second main lock portion 29 and a second auxiliary lock portion 30. The left second main lock portion 28 and the right second main lock portion 29 are formed and disposed in the hole edge portion of the second bolt hole 25. The second auxiliary lock portion 30 is formed and disposed near the second bolt hole 25. Incidentally, the configuration of the body second lock portion 26 is exemplary. It will go well if the body second lock portion 26 serves as a lock portion.

The fourth bolt hole 27 is formed and disposed on the front end side of the second grounding terminal body 22. The fourth bolt hole 27 is formed as a portion to which the bolt 9 will be inserted and as a portion which constitutes the second fastening portion 8. The fourth bolt hole 27 is formed so that a shaft portion of the bolt 9 can be inserted thereto. As is understood from the drawings, the fourth bolt hole 27 is different from the third bolt hole 25 at the point that the shape of the fourth bolt hole 27 is circular with a large diameter. On the other hand, the fourth bolt hole 27 is different from the third bolt hole 15 of the first grounding terminal 3 at the point that the shape of the fourth bolt hole 27 is circular with a large diameter while the third bolt hole 15 is oval. Incidentally, the fourth bolt hole 27 is not limited to the circular shape.

The fourth bolt hole 27 is formed and opened to be larger than the third bolt hole 15 (but formed and opened to be smaller than the washer 24 used for fastening the bolt 9. Otherwise when the washer 24 is not used, the fourth bolt hole 27 is formed and opened to be smaller than a head portion of the bolt. When a bolt (stud bolt) is instead erected on the body 2 side, the fourth bolt hole 27 is formed and opened to be smaller than a nut). The fourth bolt hole 27 and the second bolt hole 25 are disposed to be arranged in the terminal axis direction and at a predetermined distance from each other. The fourth bolt hole 27 is formed to be large enough to absorb dimensional variations or misalignment which will be described alter.

The second electric wire collective connection portion 23 is formed continuously to the rear end of the second grounding terminal body 22. The second electric wire collective connection portion 23 is formed and disposed in a position where the second electric wire collective connection portion 23 cannot interfere with the first electric wire collective connection portion 11 on the first grounding terminal 3 side when the first grounding terminal 3 and the second grounding terminal 4 are stacked on to each other. The second electric wire collective connection portion 23 is formed and disposed in a right corner position of the rear end in this example. The second electric wire collective connection portion 23 configured thus is formed as a portion which electrically and mechanically connects and fixes the electric wire group 6. In this example, the second electric wire collective connection portion 23 includes a pair of second conductor crimping pieces 31 which crimp the conductor portion of the electric wire group 6 and a pair of second sheath crimping pieces 32 which crimp the sheath portion of the electric wire group 6. The second electric wire collective connection portion 23 is formed in the same manner as the first electric wire collective connection portion 11 of the first grounding terminal 3.

In The configuration and structure, the first grounding terminal 3 and the second grounding terminal 4 are first arranged on the left and the right as shown in FIG. 1. Next, the first grounding terminal 3 and the second grounding terminal 4 are slid horizontally to approach each other so as to be stacked on to each other vertically as shown in FIG. 2. On this occasion, when the body first lock portion 14 and the body second lock portion 26 are locked, assembling the grounding terminal 1 is completed. Due to the first grounding terminal 3 and the second grounding terminal 4 stacked on to each other, the first fastening portion 7 and the second fastening portion 8 are formed. After that, the grounding terminal 1 is mounted in a predetermined position of the body 2, and a bolt 9 is inserted into the first fastening portion 7 and fastened to a threaded hole (bolt hole) of the body 2 as shown in FIG. 3. Thus, the grounding terminal 1 is first fixed in the first fastening portion 7. Next, another bolt 9 is inserted into the second fastening portion 8 and fastened to another threaded hole. Thus, the grounding terminal 1 is also fixed in the second fastening portion 8. As a result, electric connection is also completed. Although this example has been described using the bolts 9, for example, another fixation in which bolts (stud bolts) erected on the body 2 side are inserted into the grounding terminal 1 and fastened by nuts may be used.

In this example, even if the threaded hole of the body 2 located correspondingly to the second fastening portion 8 is not formed according to its designed size but is misaligned, the misalignment can be absorbed by the configuration and structure of the second fastening portion 8. That is, the grounding terminal 1 according to the invention can make normal grounding connection. In addition, in this example, even if slight looseness occurs when the body first lock portion 14 and the body second lock portion 26 are locked, misalignment can be absorbed by the configuration and structure of the second fastening portion 8.

As has been described above with reference to FIG. 1 to FIG. 3, the grounding terminal 1 has a structure in which the first grounding terminal 3 and the second grounding terminal 4 are provided so that two fastening portions can be formed when the first grounding terminal 3 and the second grounding terminal 4 are stacked on to each other and locked with each other. In addition, the grounding terminal 1 has a structure in which one (the second fastening portion 8) of the two fastening portions (the first fastening portion 7 and the second fastening portion 8) is formed into a state where an elliptic or oval bolt insertion portion (the third bolt hole 15) and a circular bolt insertion portion (the fourth bolt hole 27) are stacked on to each other. Accordingly, it is possible to absorb dimensional variations or misalignment caused by formation of bolt holes or erection of bolts on the body 2 side, dimensional variations or misalignment caused by manufacturing of the grounding terminal 1, and misalignment occurring when the first grounding terminal 3 and the second grounding terminal 4 are put on each other and locked with each other. When the structure is used, there is an effect that normal grounding connection can be achieved.

In addition, the first fastening portion 7 and the second fastening portion 8 are provided according to the grounding terminal 1. Accordingly, even if looseness occurs in any one of the bolts 9, the state of fixation can be kept. As a result, there is an effect that the grounding function can be kept. In addition, the first electric wire collective connection portion 11 and the second electric wire collective connection portion 23 are provided according to the grounding terminal 1. Accordingly, there is another effect that a large number of grounding circuits can be connected compactly and inexpensively at a reduced number of grounding points.

EXAMPLE 2

Figure 4:
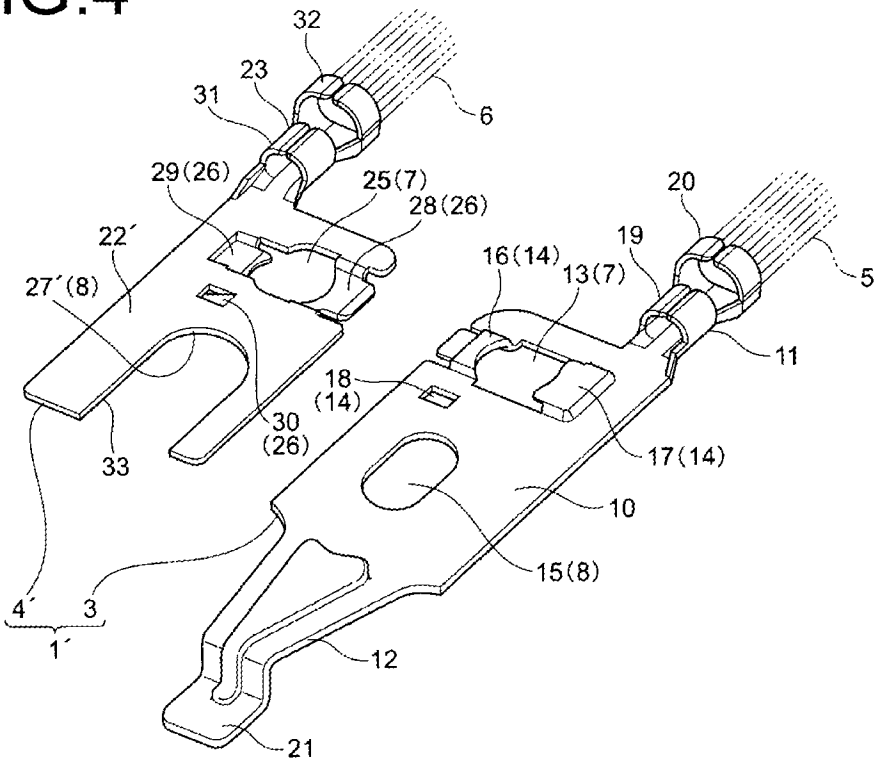
FIG. 4 is a perspective view showing another example of a grounding terminal according to the invention, in which a first grounding terminal and a second grounding terminal have not yet been stacked on to each other (Example 2).
Figure 5:
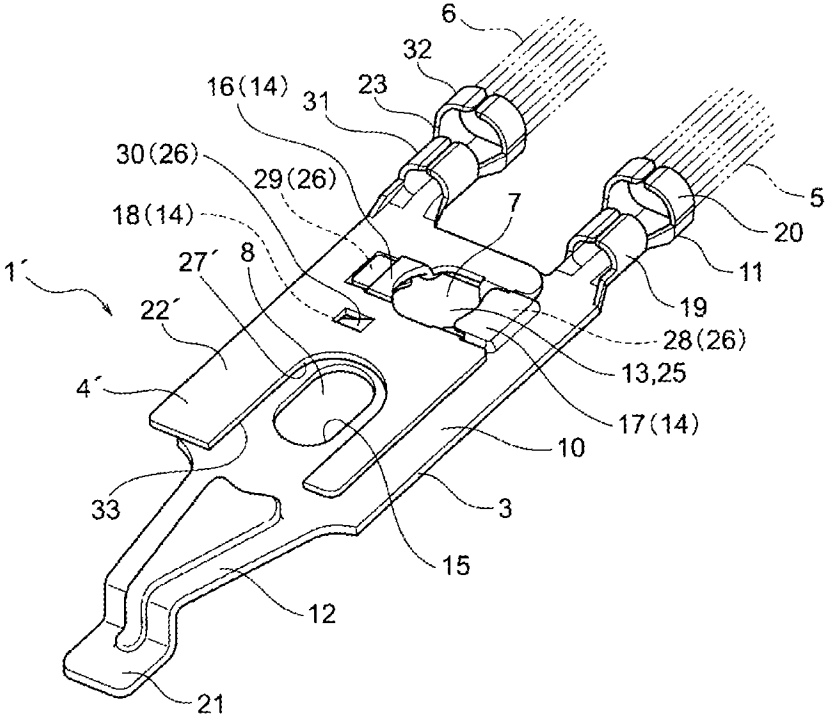
FIG. 5 is a perspective view showing a state in which the first grounding terminal and the second grounding terminal in FIG. 4 have been stacked on to each other and locked with each other (Example 2).
Figure 6:
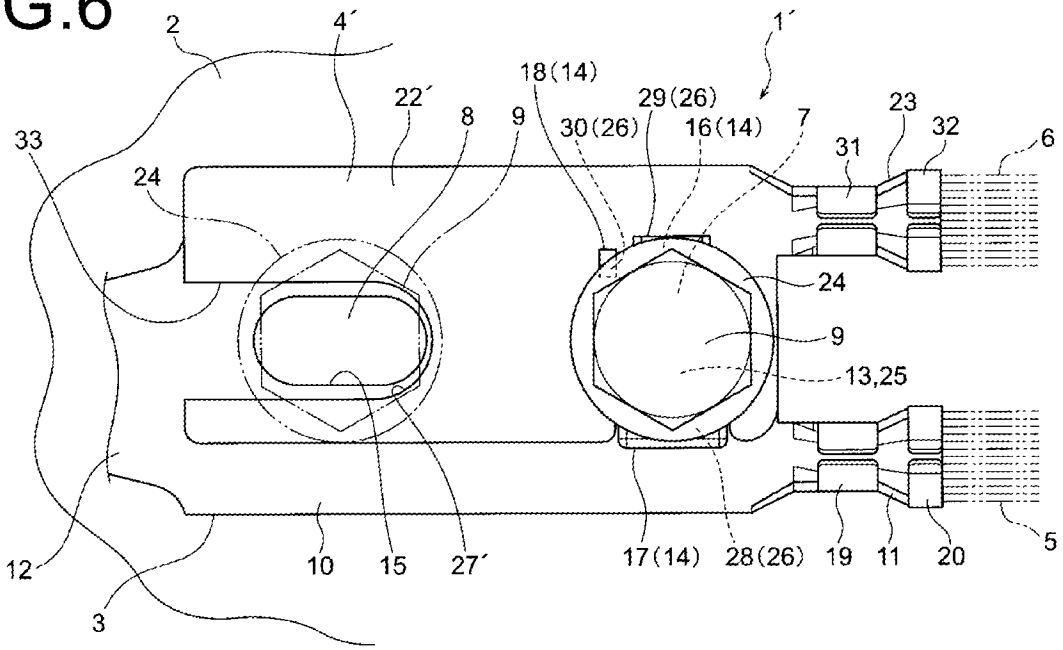
FIG. 6 is a plan view showing a state in which the first grounding terminal and the second grounding terminal in the state of FIG. 5 are being fastened by bolts (Example 2).
Figure 7:
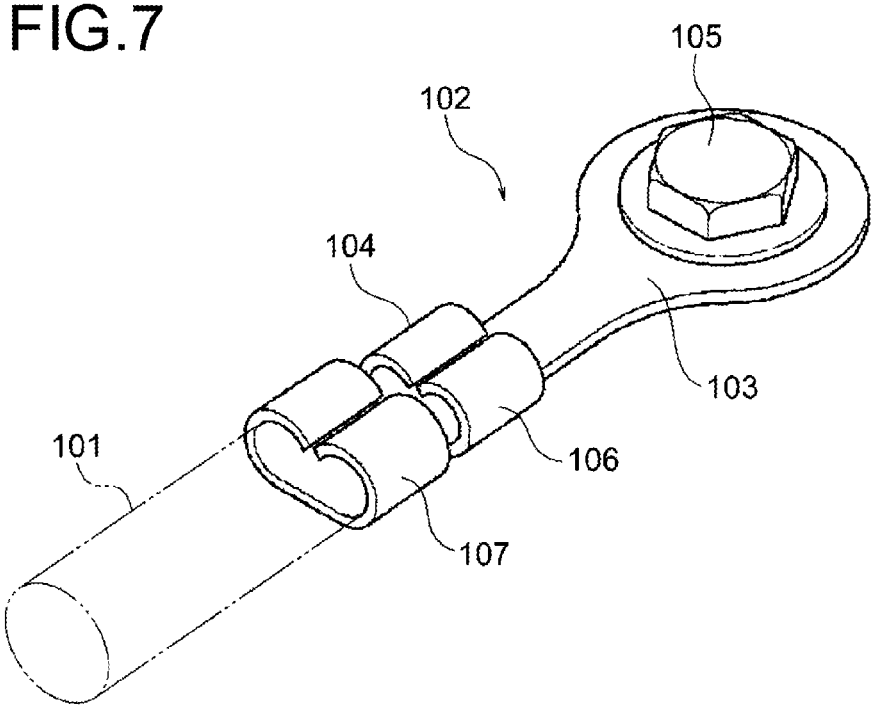
FIG. 7 is a perspective view showing a state in which a terminal fitting in a comparative example is fastened.
Figure 8:
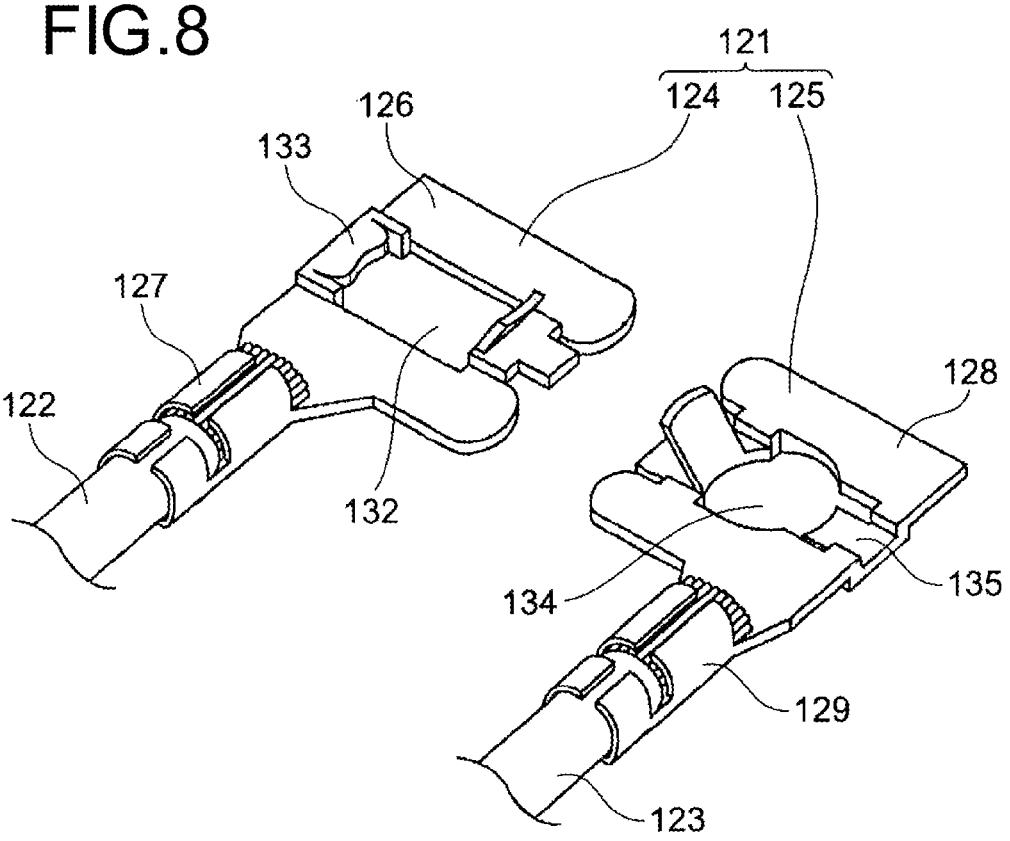
FIG. 8 is a perspective view showing a grounding terminal according to a comparative example, in which a first grounding terminal and a second grounding terminal have not yet been stacked on to each other.
Figure 9:
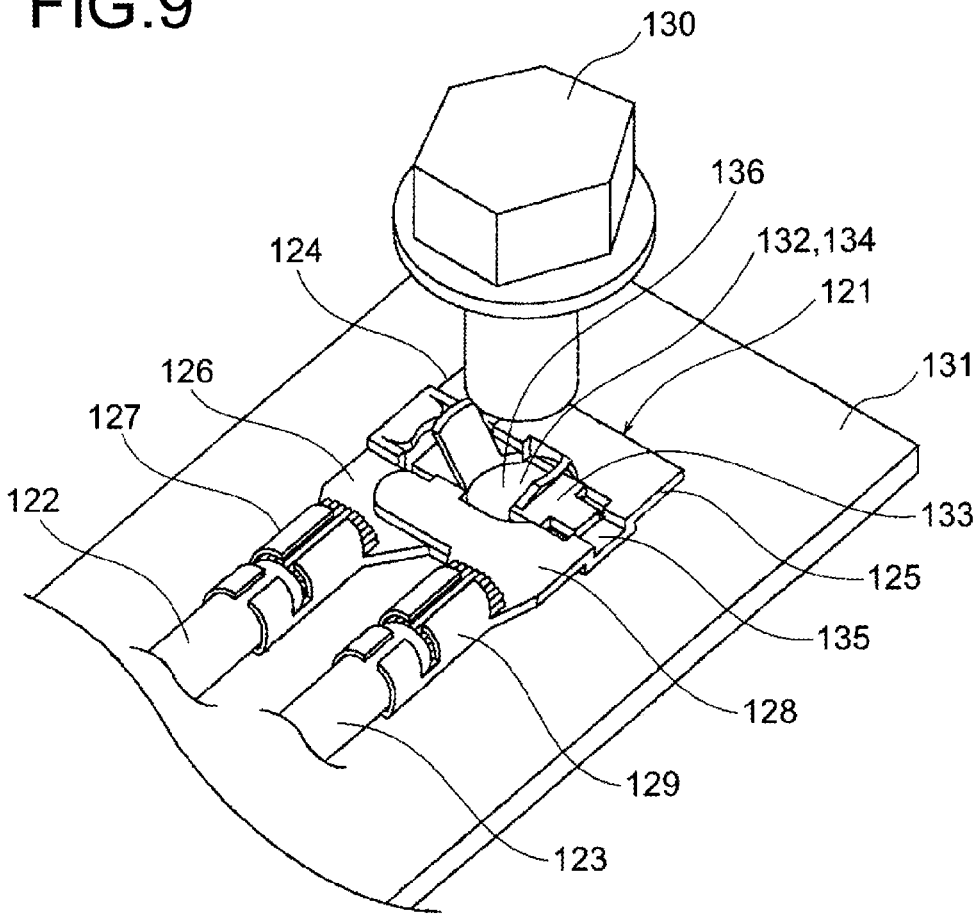
FIG. 9 is a perspective view showing a state in which the first grounding terminal and the second grounding terminal in the comparative example of FIG. 8 have been stacked on to each other and locked with each other but immediately before fastening with bolts is started.
Figure 10:
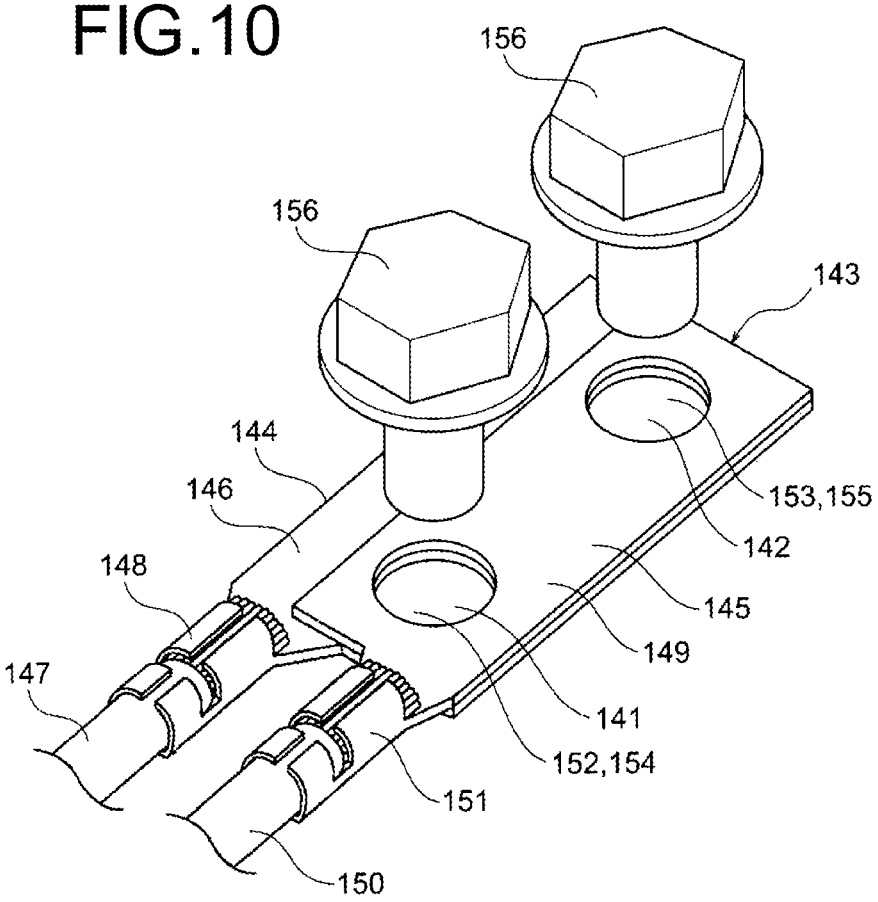
FIG. 10 is a perspective view showing a problem in a grounding terminal including two fastening portions.

Example 2 will be described below with reference to the drawings. FIG. 4 is a perspective view showing another example of a connection structure of a grounding terminal according to the invention, in which a first grounding terminal and a second grounding terminal have not yet been stacked on to each other. FIG. 5 is a perspective view showing a state in which the first grounding terminal and the second grounding terminal in FIG. 4 have been stacked on to each other and locked with each other. FIG. 6 is a plan view showing a state in which the first grounding terminal and the second grounding terminal in the state of FIG. 5 are being fastened by bolts. Constituent members fundamentally the same as those in The Example 1 are referenced correspondingly or with a dash, and detailed description thereof will be omitted.

In FIG. 4 to FIG. 6, a grounding terminal 1' according to Example 2 is a modification of Example 1, which is designed to include a first grounding terminal 3 and a second grounding terminal 4'. The first grounding terminal 3 is the same as that in Example 1. The second grounding terminal 4' includes a second grounding terminal body 22' and a second electric wire collective connection portion 23. A second bolt hole 25, a body second lock portion 26 and a fourth bolt insertion portion 27' are formed in the second grounding terminal body 22'. In the second grounding terminal 4', a notch portion 33 is added to the second grounding terminal in Example 1 so as to form the fourth bolt insertion portion 27'.

The notch portion 33 is formed by notching a hole edge portion on the side leaving the second bolt hole 25. In addition, the notch portion 33 is formed to be not smaller than the lateral opening width of the third bolt hole 15 in the first grounding terminal 3. Due to the formation of the notch portion 33, the portion of the fourth bolt insertion portion 27' is formed to be open in a U-shape. The illustrated shape of the fourth bolt insertion portion 27' is an alternative example of the fourth bolt hole 27 in Example 1. According to the invention, the shape of the fourth bolt insertion portion 27 is not limited to a "hole" but may be a "slit" or the like. Incidentally, the contact area with the washer 24 is slightly reduced. However, there is no problem as long as the reduction is about the illustrated opening of the notch portion 33.

In The configuration and structure, it is a matter of course that the grounding terminal 1' in Example 2 has similar effects to those in Example 1. Accordingly, there is an effect that normal grounding connection can be achieved. In addition, there is an effect that the grounding function can be kept even if looseness occurs in any bolt 9. Further, there is an effect that a large number of grounding circuits can be connected compactly and inexpensively at a reduced number of grounding points.

In addition, it is a matter of course that various changes can be performed on the invention without departing from the gist of the invention.

In The description, the third bolt hole 15 is formed in the first grounding terminal 3 and the fourth bolt hole 27 is formed in the second grounding terminal 4. Therefore, the lower hole has an oval shape (or an elliptic shape) and the upper hole has a circular shape. The invention is not limited to this, but the shapes of the upper and lower holes may be reversed (the fourth bolt hole 27 and the third bolt hole 15 may be disposed upside down). In addition, in the aforementioned description, each electric wire group 5, 6 consists of a large number of electric wires. The invention is not limited to this, but each electric wire group 5, 6 may consist of, for example, a single electric wire (high-voltage electric wire or a low-voltage electric wire).

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2014-062167 filed on Mar. 25, 2014, the contents of which are incorporated herein by reference.

What is claimed is:

1. A grounding terminal comprising:

a first grounding terminal including a first bolt insertion portion and a third bolt insertion portion; and a second grounding terminal including a second bolt insertion portion and a fourth bolt insertion portion, wherein in a state that the first grounding terminal and the second grounding terminal are stacked on to each other and locked with each other, the first grounding terminal and the second grounding terminal are fastened and fixed to a fixation target by a first bolt and a second bolt at a first fastening portion and a second fastening portion;

wherein in the first fastening portion, the first bolt insertion portion and the second bolt insertion portion are stacked on to each other and locked with each other;

wherein in the second fastening portion, the third bolt insertion portion and the fourth bolt insertion portion are stacked on to each other, the third bolt insertion portion having an elliptic shape or an oval shape whose longitudinal direction is a direction in which the first fastening portion and the second fastening portion are aligned; and wherein the fourth bolt insertion portion is opened and formed to be larger than the third bolt insertion portion and smaller than a fastening member.

2. The grounding terminal according to claim 1, wherein the first grounding terminal and the second grounding terminal include electric wire collective connection portions which collectively connect terminals of a plurality of electric wires, respectively.

* * * * *